US009595413B2

(12) United States Patent
Yang

(10) Patent No.: US 9,595,413 B2
(45) Date of Patent: Mar. 14, 2017

(54) LOW INSTANTANEOUS LEVEL CIRCUIT BREAKERS, CIRCUIT BREAKER TRIPPING MECHANISMS, AND TRIPPING METHODS

(71) Applicant: Siemens Industry, Inc., Alpharetta, GA (US)

(72) Inventor: Guang Yang, Suwanee, GA (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 127 days.

(21) Appl. No.: 14/326,781

(22) Filed: Jul. 9, 2014

(65) Prior Publication Data

US 2016/0012999 A1 Jan. 14, 2016

(51) Int. Cl.

| | |
|---|---|
| ***H01H 71/40*** | (2006.01) |
| ***H01H 50/64*** | (2006.01) |
| ***H01H 71/24*** | (2006.01) |
| ***H01H 71/12*** | (2006.01) |
| ***H01H 71/02*** | (2006.01) |
| ***H01H 71/10*** | (2006.01) |

(52) U.S. Cl.

CPC ..... *H01H 71/40* (2013.01); *H01H 50/644* (2013.01); *H01H 71/0271* (2013.01); *H01H 71/1045* (2013.01); *H01H 71/12* (2013.01); *H01H 71/2436* (2013.01)

(58) Field of Classification Search

CPC ..... H01H 71/0271; H01H 71/1045; H01H 71/12; H01H 71/2436; H01H 71/02; H01H 71/405; H01H 2205/002; H01H 71/40; H01H 50/644; Y10T 29/49105

See application file for complete search history.

(56) References Cited

U.S. PATENT DOCUMENTS

| | | | | |
|---|---|---|---|---|
| 2,411,892 | A | 12/1946 | Peters | |
| 3,246,098 | A | 4/1966 | Hall | |
| 4,451,718 | A | 5/1984 | Hisatsune | |
| 7,199,319 | B1 * | 4/2007 | Rodgers | H01H 71/0214 200/293 |
| 2010/0238611 | A1 | 9/2010 | DeBoer et al. | |
| 2013/0271257 | A1 | 10/2013 | Yang | |

FOREIGN PATENT DOCUMENTS

| | | | | |
|---|---|---|---|---|
| DE | 3515158 | A1 * | 11/1986 | H01H 71/1045 |
| EP | 1949401 | A1 | 7/2008 | |
| GB | 804428 | A * | 11/1958 | H01H 71/40 |

OTHER PUBLICATIONS

European Search Report mailed Nov. 6, 2015 corresponding to European Application No. 15175257.3 filed Jul. 3, 2015 (9 pages).

* cited by examiner

*Primary Examiner* — Mohamad Musleh

(57) ABSTRACT

A circuit breaker tripping mechanism providing relatively low instantaneous level tripping is disclosed. Circuit breaker tripping mechanism includes an armature with a first portion extending in a first direction from an armature pivot and a second portion extending in a second direction from the armature pivot, and a magnetic field generator configured as part of a line conductor. Magnetic field generator is operable to produce a magnetic field acting upon the second portion during a short circuit. Circuit breakers including the circuit breaker tripping mechanism and methods of tripping a circuit breaker are provided, as are other aspects.

9 Claims, 6 Drawing Sheets

LOW INSTANTANEOUS LEVEL CIRCUIT BREAKERS, CIRCUIT BREAKER TRIPPING MECHANISMS, AND TRIPPING METHODS

FIELD

The present invention relates generally to electrical circuit breakers, and more particularly to tripping mechanisms for such circuit breakers.

BACKGROUND

In general, an electrical circuit breaker operates to engage and disengage a selected branch electrical circuit from an electrical power supply. The circuit breaker ensures current interruption thereby providing protection to the electrical circuit from unwanted electrical conditions, such as continuous over-current conditions and high current transients due, for example, to electrical short circuits. Such circuit breakers operate by separating a pair of internal electrical contacts contained within a housing (e.g., molded case) of the circuit breaker.

Typically, one electrical contact is stationary, while the other is movable. Conventional circuit breakers may include a moving electrical contact mounted on an end of a moving (e.g., pivotable) contact arm, such that the moving electrical contact moves through a separation path. Contact separation between the moving and stationary electrical contacts may also occur manually, such as by a person throwing a handle of the circuit breaker.

In the case of a tripping event (e.g., a short circuit), an armature may be de-latched so as to release the contact arm and open the electrical contacts of the circuit breaker. Conventionally, tripping may be accomplished by a tripping mechanism wherein the armature is actuated via attraction to a magnet contained in the current path to cause de-latching of a cradle from the armature according to existing designs.

It is desirable for circuit breakers with low handle ratings (e.g., 15 A, 20 A, and 30 A handle rating circuit breakers), that the threshold tripping condition for a short circuit condition be relatively low. In existing designs, however, the magnet of the bimetal element and magnet assembly only operates at about 150 A or more for a 15 A circuit breaker (about 10× or more than the circuit breaker handle rating), about 150 A or more for a 20 A circuit breaker (about 7.5× or more than the circuit breaker handle rating), and about 300 A or more for a 30 A circuit breaker (about 10× or more than the circuit breaker handle rating).

In one common design of the bimetal element and magnet assembly, the magnet is a U-shaped steel piece, which is magnetized when current passes through the U-shape steel piece. This operates as a magnet and attracts the armature of the circuit breaker to de-latch the armature from the cradle and open the electrical contacts when the current through the U-shape steel piece reaches the so-called "instantaneous level." In designs including an existing bimetal element and magnet assembly, lowering the instantaneous level of the circuit breaker is a significant challenge.

Accordingly, there is a need for circuit breakers and tripping mechanisms thereof that offer relatively-lower instantaneous levels.

SUMMARY

According to a first aspect, a circuit breaker tripping mechanism is provided. The circuit breaker tripping mechanism includes an armature including a first portion extending in a first direction from an armature pivot, and a second portion extending in a second direction from an armature pivot, and a magnetic field generator configured as part of a line conductor that is operable to produce a magnetic field acting on the second portion during a short circuit.

In accordance with another aspect, a circuit breaker is provided. The circuit breaker includes a housing, a first electrical contact and a second electrical contact within the housing, a line conductor electrically connected between the first electrical contact and a line connector, and a circuit breaker tripping mechanism within the housing, including an armature including a first portion extending in a first direction from an armature pivot, and a second portion extending in a second direction from the armature pivot, and a magnetic field generator configured as part of the line conductor that is operable to produce a magnetic field acting on the second portion during a short circuit.

In accordance with another aspect, a method of tripping a circuit breaker is provided. The method includes providing a circuit breaker tripping mechanism in the circuit breaker including an armature with a first portion extending in a first direction from an armature pivot, and a second portion extending in a second direction from the armature pivot, and a magnetic field generator configured as part of a line conductor, and producing a magnetic field acting on the second portion during a short circuit.

Still other aspects, features, and advantages of the present invention may be readily apparent from the following detailed description by illustrating a number of example embodiments and implementations, including the best mode contemplated for carrying out the present invention. The present invention may also be capable of other and different embodiments, and its several details may be modified in various respects, all without departing from the scope of the present invention. Accordingly, the drawings and descriptions are to be regarded as illustrative in nature, and not as restrictive. The invention is to cover all modifications, equivalents, and alternatives falling within the scope of the invention.

DETAILED DESCRIPTION

Embodiments of the present invention concern providing improved response to short circuit fault conditions in circuit breakers. One or more embodiments of the present invention provide an improved tripping mechanism that is operative to lower the instantaneous level of the circuit breaker. Instantaneous level is the current level that results in tripping of the circuit breaker. Some embodiments of the improved tripping mechanism may be operative to better control the instantaneous level, i.e., to provide adjustment or calibration thereof.

Figure 1:
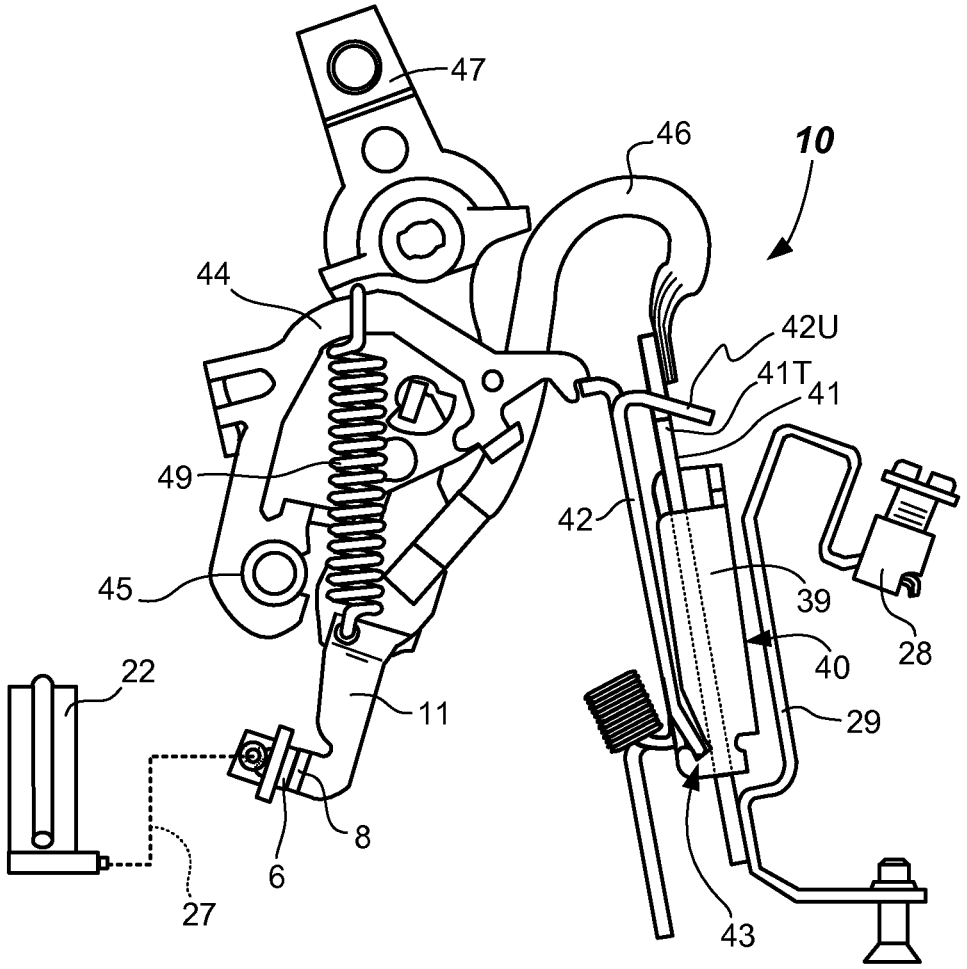
FIG. 1 Prior Art
FIG. 1 illustrates a side view of a tripping mechanism of a circuit breaker according to the Prior Art with some other circuit breaker components (e.g., housing) removed for clarity.

An existing design of a tripping mechanism 10 of a circuit breaker and other operating mechanism components thereof is shown in FIG. 1. The line power (on a line side) is connectable to a line connector 22 inside the circuit breaker. Line connector 22 is electrically connected to a stationary contact 6 by a wire conductor 27. The connector 22 to line power may be different for different circuit breaker styles. For a plug-in type circuit breaker, line connector 22 can be a spring clip (as shown), and for bolt-on type circuit breaker, it can be a metal strip with pre-designed screw holes therein.

Contact between the stationary electrical contact 6 and the moveable electrical contact 8 passes electrical current through the contact arm 11, through the braided conductor 46 coupled to the contact arm 11, through the bimetal 41 of a bimetal and magnet assembly 40, and through load conductor 29 to the load terminal 28. The electrical load may be connected at the load terminal 28.

Other than the current path mentioned above, a conventional circuit breaker may also include an operating mechanism which includes a handle 47, a cradle 44, a spring 49, a magnet 39 of the bimetal and magnet assembly 40, and an armature 42. The user can throw the handle 47 to manually separate the stationary and moveable electrical contacts 6, 8, or if a circuit fault happens, the armature 42 may be rotated clockwise about the armature pivot 43 to de-latch the cradle 44. The cradle 44 is then rotated clockwise about the cradle pivot 45 by the action of spring 49, which in turn rotates the contact arm 11 to separate the stationary and moveable electrical contacts 6, 8.

For traditional thermal-magnetic circuit breakers, there are two ways to trip the circuit breaker, depending upon the current levels that are present. At persistent low current levels, the bimetal 41 bends as it is heated up due to resistive heating and eventually causes the top end 41T to contact the upper portion 42U of the armature 42, rotate the armature 42, thus de-latching the cradle 44. At high current levels (e.g., due to short circuit conditions), the magnet 39 magnetically attracts the armature 42 to de-latch the cradle 44 and ensure fast response. The current level at which the magnet 39 causes de-latching is called the "instantaneous level." Conventionally, the circuit breaker mechanism is enclosed within a housing (not shown), which may include two or more parts.

In accordance with one aspect, embodiments of the invention provide an improved circuit breaker tripping mechanism having relatively lower instantaneous level. Improved circuit breaker tripping mechanism includes an armature and a magnetic field generator. The magnetic field generator is configured as part of a line conductor and is operational to produce a magnetic field acting on the armature during a short circuit. Armature may include a first portion extending in a first direction from an armature pivot, and a second portion extending in a second direction from the armature pivot. The magnetic field generator may attract the second portion thereby providing an assisting force to supplement the force acting on the armature that is provided by the magnet and cause rotation of the armature at relatively lower instantaneous level of current.

The principles of the present invention are not limited to the illustrative examples depicted herein, but may be applied and utilized in any type of circuit breaker including a tripping-type electrical contact assembly. For example, embodiments of the present invention may be useful in single-pole circuit breakers, duplex circuit breakers, two-pole circuit breakers, multi-pole circuit breakers, metering circuit breakers, electronic trip unit breakers, remotely-controllable circuit breakers, and the like.

These and other embodiments of the circuit breaker tripping mechanism, circuit breakers containing the improved tripping mechanism and methods of tripping circuit breakers according to the present invention are described below with reference to FIGS. 1-5 herein. Like reference numerals used in the drawings identify similar or identical elements throughout the several views. The drawings are not necessarily drawn to scale.

Figure 2A:
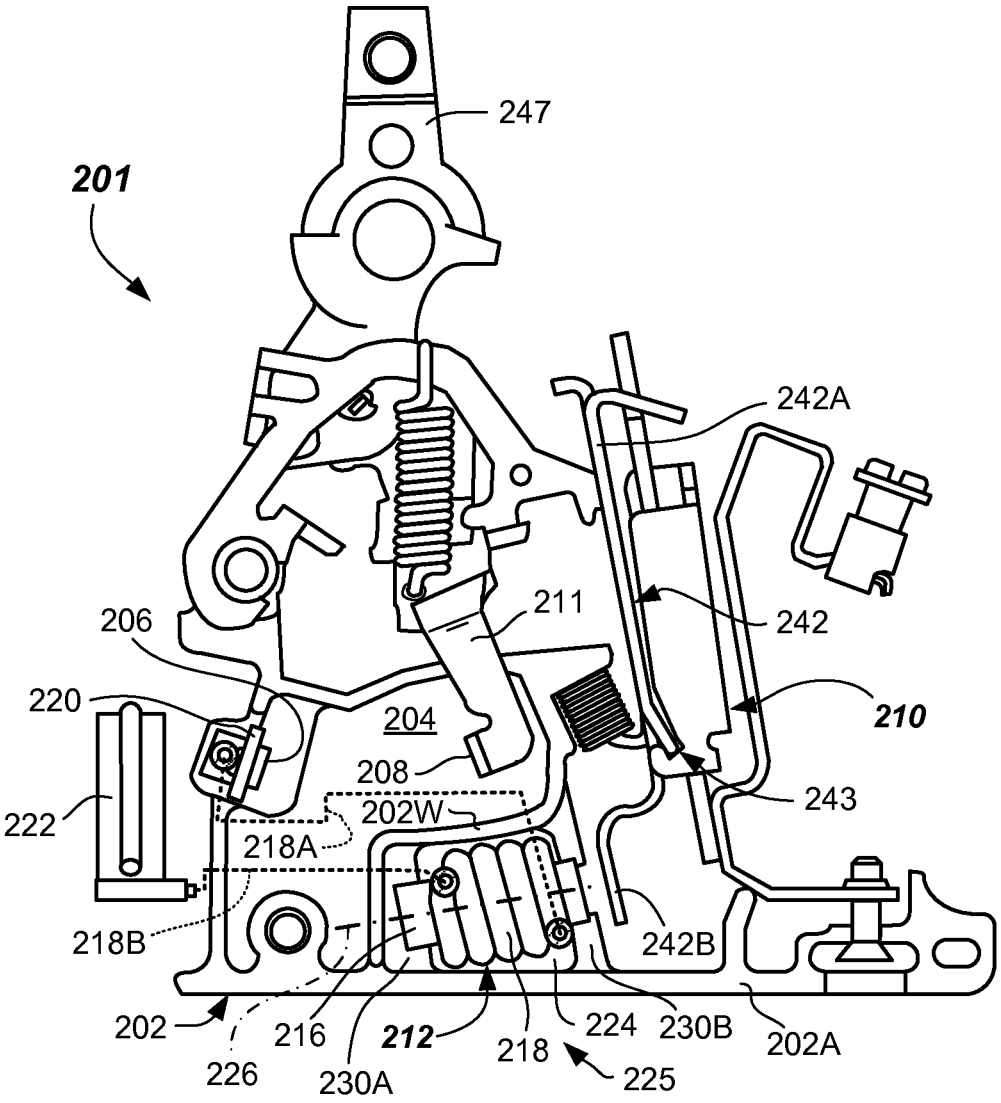
FIG. 2A illustrates a partial side view of a tripping mechanism of a circuit breaker according to embodiments with only a portion of the housing shown.

Referring now to FIGS. 2A-2C, 3, and 4, one or more embodiments of circuit breaker 201 and components thereof are shown and described (only a portion shown in FIG. 2A for clarity). The improved circuit breaker tripping mechanism 210 in accordance with one or more embodiments of the invention is included in circuit breaker 201. The circuit breaker 201 includes a housing 202 (only a portion of a first housing part 202A is shown in FIG. 2A), which may be molded case housing (e.g., a molded circuit breaker housing) made from a suitable polymer or plastic material, for example. The material may be a thermoset material, such as a glass-filled polyester, or a thermoplastic material such as a Nylon material (e.g., Nylon 6), for example. Other suitable housing materials may be used.

Figure 4:
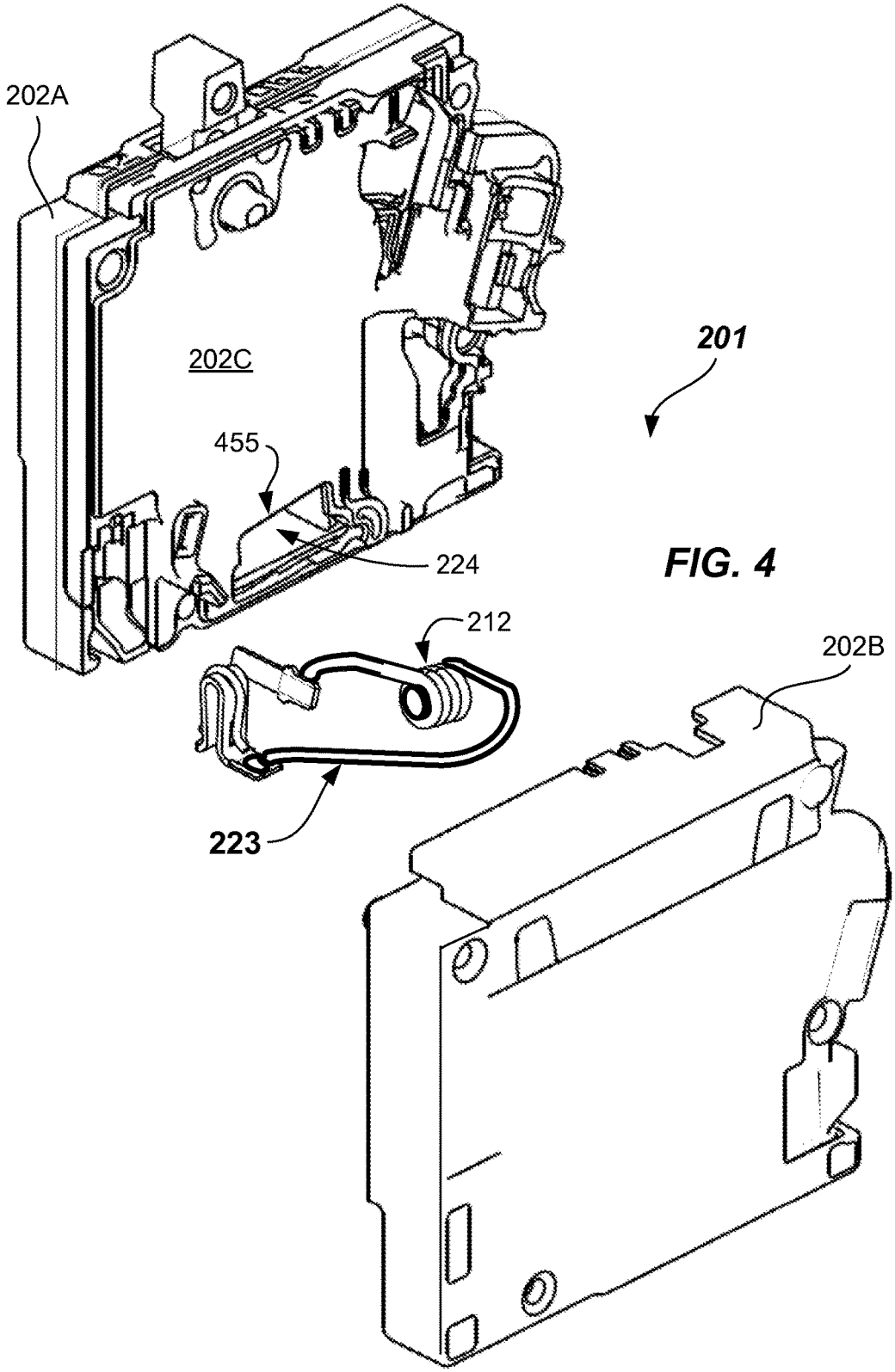
FIG. 4 illustrates an exploded perspective view of a circuit breaker including a tripping mechanism with a magnetic field generator according to embodiments.

Housing 202 may be made up of two more parts, or even three or more parts (e.g., first housing part 202A, second housing part 202B, and even an intermediate housing part 202C—see FIG. 4) in some embodiments. First, second, and intermediate housing parts 202A, 202B, and 202C may be connected together using fasteners (e.g., screws, rivets, or the like). Housing 202 may include multiple walls that may interface to form an arc chamber 204 in some embodiments.

Circuit breaker 201 includes a first electrical contact 206, which is generally located within the arc chamber 204, and a second electrical contact 208 also generally located within the arc chamber 204. First electrical contact 206 and second electrical contact 208 are separable from each other, and may comprise conventional electrical contact construction. In the depicted embodiment, first electrical contact 206 may be a stationary electrical contact, whereas the second electrical contact 208 may be a moveable electrical contact. However, the invention will work equally well in embodiments where both the first electrical contact 206 and the second electrical contact 208 are both moveable contacts.

In the illustrated embodiment, the second electrical contact 208 is shown coupled to a contact arm 111 that is moveable (e.g., pivotable). Contact arm 111 may be of any conventional construction, and is generally pivotable responsive to an interrupt event (e.g., short circuit condition or persistent over-current condition) to cause contact separation.

In more detail, the tripping mechanism 210 according to one or more embodiments includes a magnetic field generator 212 that, in the depicted embodiment, is positioned proximate to the first electrical contact 206 and the second electrical contact 208. Magnetic field generator 212 is configured and operable to produce a magnetic field having sufficient magnetic field strength to attract a portion of the armature 242. Magnetic field generator 212 may be located in a side chamber 224 of the first housing part 202A in the depicted embodiment. Magnetic field generator 212 may be placed into the housing 202 facing a portion of the armature 242, such as second portion 242B as is shown in an unlatch condition in FIG. 2C.

Figure 2B:
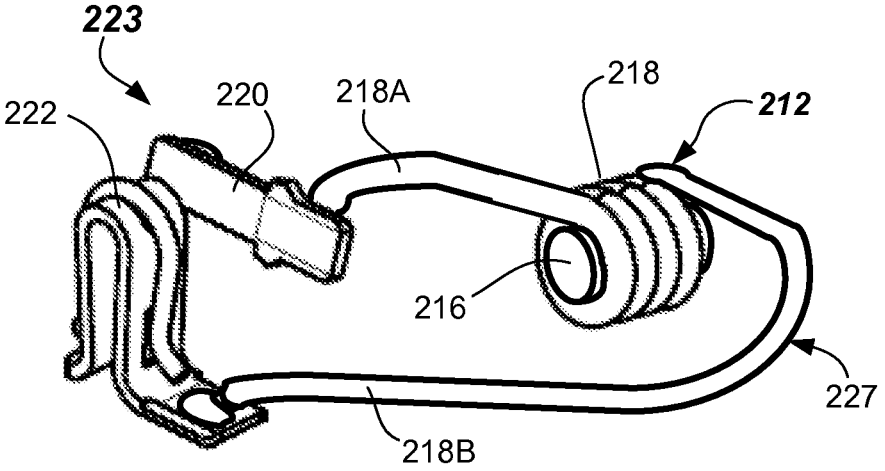
FIG. 2B illustrates a perspective view of a magnetic field generator configured as part of a line conductor according to embodiments.
Figure 2C:
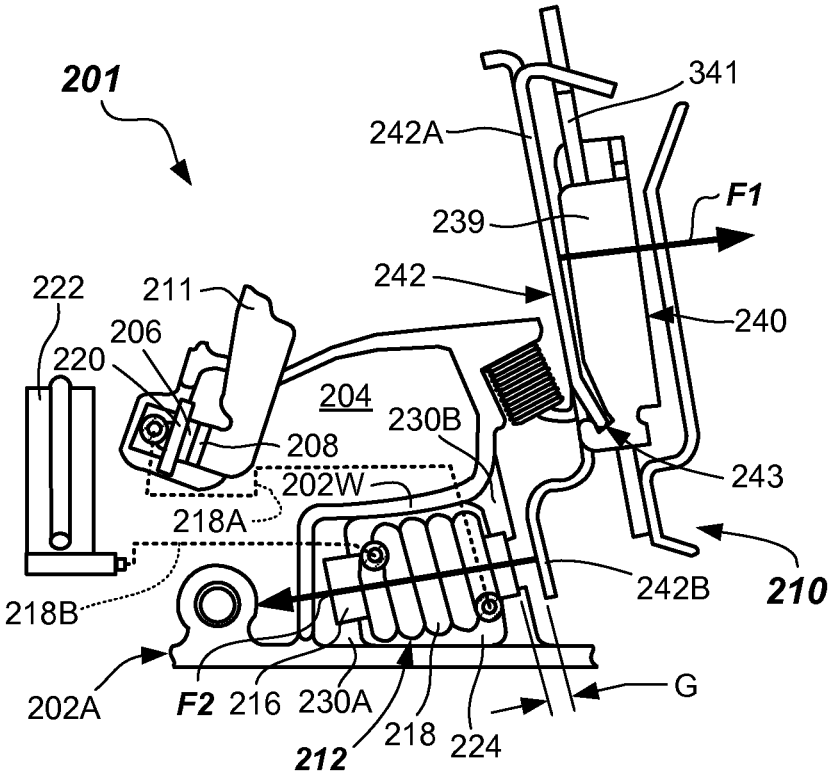
FIG. 2C illustrates a partial side view of a tripping mechanism including a magnetic field generator showing the primary force F1 and assisting force F2 that are present during a short circuit according to embodiments.

Magnetic field generator 212 may include, as best shown in FIGS. 2A and 2B, a core 216 and a coil of wire 218 wound about the core 216. The core 216 may be a magnetically susceptible ferromagnetic material, such as steel (e.g., low-carbon steel) or iron material. For example, core 216 may be a 1006, 1008, or 1010 steel. In other embodiments, core 216 may be a powdered iron material. Core 216 may have a rod shape in some embodiments, and may have a diameter "d" of between about 0.1 inch and about 0.3 inch (between about 2.5 mm and about 7.6 mm), or even between about 0.15 inch to about 0.25 inch (between about 3.8 mm and about 6.4 mm) in some embodiments. Core 216 may have a length "L" of between about 0.15 inch and about 1.0 inch (between about 3.8 mm and about 25.4 mm). Other "d" and "L" dimensions and shapes of the core 216 and suitable materials for the core 216 may be used. Magnetic field generator 212 may be precisely positioned within the housing 202 of the circuit breaker 201 by one or more retention features 230A, 230B, which may be molded tabs (as shown in FIGS. 2A and 2C). Other suitable means for holding the magnetic field generator 212 in a defined position relative to the second portion 242B of the armature 242 may be used.

The coil of wire 218 may be a 16 gauge wire, and may include polymer insulation thereon. The number of coils wrapped (wraps) around the core 216 may between about 2 and about 6, and about five in some embodiments. However, the number of coils may vary depending on the current that is present in the main current path during an interruption event (e.g., short circuit). Current in the main current path during a short circuit interrupt event may be between 200 A to 4 KA, for example.

On a first end 218A, the coil of wire 218 that is wound about the core 216 may be electrically connected to the first electrical contact 206. For example, a first end 218A of a wire conductor 227 (FIG. 2C) extending from the coil of wire 218 may be brazed, welded or crimped to a contact support 220. Contact support 220 may be an electrically conductive metal piece received in a pocket of the housing 202, for example, or may otherwise be fixed to the housing 202. Contact support 220 includes the first electrical contact 206 secured (e.g., welded) thereon. On a second end 218B, an extension of the wire conductor 227 from the coil of wire 218 that is wound about the core 216 may be electrically connected to a line connector 222 as shown in FIGS. 2A and 2B.

As best shown in FIG. 2B, line conductor 223, which may be a separate assembly, includes the contact support 220, first end 218A of wire conductor 227 electrically connected to contact support 220, coil of wire 218 formed as part of the wire conductor 227 in between the first and second ends 218A, 218B, and second end 218B of wire conductor 227 electrically connected to the line connector 222. Each electrical connections may be by welding, crimping, braising, or the like. Magnetic field generator 212 is configured as part of the line conductor 223 by wrapping the wire conductor 227 about the core 216. Line conductor 223 is electrically connected between the first electrical contact 206 and the line connector 222, as shown.

Line connector 222 may be configured to electrically couple to a source of line power, such as to a conductor within a panel box, panel board, or the like. For example, line connector 222 may be a spring clip (e.g., a C-shaped clip) that may be retained in the housing 202 (e.g., between first and second housing parts 202A, 202B) and may be configured and adapted to secure to a stab within a panel box, panel board, or other electrical enclosure. In another embodiment, the line connector 222 may be a metal bar or strip, which may include one or more fastener holes adapted to couple to a conductive line power component, or the like. Other suitable structures for the line connector 222 may be used.

In the embodiments of FIGS. 2A-2C, 3, and 4 the magnetic field generator 212 may be confined to a side chamber 224 formed within or by parts of the first housing part 202A. The side chamber 224 may be located adjacent to, and in close proximity to, the arc chamber 204 in one or more embodiments. In this and other embodiments, there may be a separating wall 202W provided between the location of the first and second electrical contacts 206, 208 within the arc chamber 204 and the magnetic field generator 212. Separating wall 202W may form a part of the arc chamber 204 and a part of the side chamber 224 in some embodiments. The separating wall 202W may shield the portion of the line conductor 223 that is located within the side chamber 224 (e.g., the coil of wire 218 and portions of the first and second ends 218A, 218B). The remainder of the line conductor 223 may pass through another part of the housing 202 (e.g., second housing part 202B of the housing 202—see FIG. 4) having been separated by the intermediate housing part 202C.

In the depicted embodiment of FIGS. 2A and 3, the magnetic field generator 212 may situated at the bottom 225 of the housing 202 of the circuit breaker 201 (e.g., opposite the handle 247 in the circuit breaker 201), and may be mounted below (as shown) the arc chamber 204.

Figure 3:
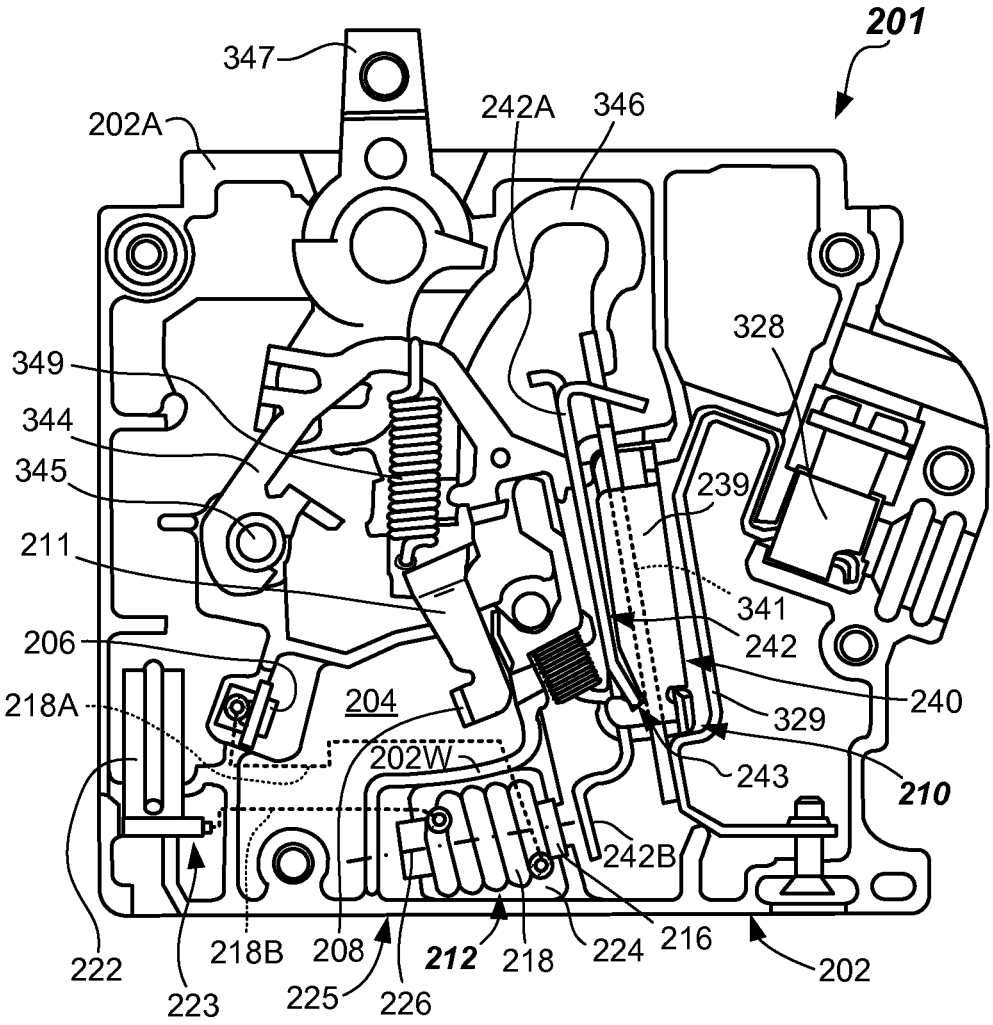
FIG. 3 illustrates a side plan view of a first part of a circuit breaker including a tripping mechanism and other circuit breaker operating mechanism components according to embodiments.

In each embodiment, such as shown in FIGS. 2A and 3, the core 216 of the magnetic field generator 212 may have an axial axis 226 that is directed (e.g., generally perpendicularly) towards the second portion 242B of the armature 242. Armature 242 includes a first portion 242A extending in a first direction (e.g., upward as shown) from an armature pivot 243, and a second portion 242B extending in a second direction (e.g., downward) from the armature pivot 243. In operation, a magnetic field is generated by the magnetic field generator 212 as current passes through the line conductor 223 and coil of wire 218 formed therein during a short circuit. The magnetic field produced in the core 216 may have a magnetic field strength of greater than about 1 Tesla, greater than about 1.5 Tesla, and between about 1.6 and 1.8 Tesla in some embodiments. Magnetic field generator 212, being configured as part of a line conductor 223, is operational to be energized by current flowing in the line conductor 223 when a short circuit is encountered. This current flow produces a magnetic field acting on and producing an assisting force F2 on the second portion 242B (FIG. 2C). This assisting force F2 causes the second portion 242B, which is made of a ferromagnetic material such as low carbon steel, or the like, to be pulled closer to the end of the core 216.

As shown in FIG. 2C, this assisting force F2 that acts on the second portion 242B is in addition to the primary force F1 generated by the magnet 239 which acts on the first portion 242A of the armature 242 during a short circuit. The two forces act in unison, above and below the armature pivot 243 and cause torque on the armature 242 and cause tripping (e.g., de-latching of the cradle) of the circuit breaker 201. The assisting force F2 produced by the magnetic field generator 212 may be between about 0.1 lbs. and about 0.8 lbs., for example. Other levels of assisting force F2 may be provided. It is preferably that the assisting force F2 act as far away from the armature pivot 243 as is practical. As a result of the assisting force F2 being additive to the conventional primary force F1, the instantaneous level for the circuit breaker 201 may be lowered.

For example, the instantaneous level for the circuit breaker 201 having a 15 A handle rating may be made less than about 120 A (including less than about 110 A, less than about 100 A, and even less than about 90 A). Instantaneous level for the circuit breaker 201 having a 15 A handle rating may be made to be between about 90 A and about 120 A in some embodiments.

The instantaneous level for the circuit breaker 201 having a 20 A handle rating may be less than about 140 A (including less than about 130 A, less than about 120 A, less than about 110 A, and even less than about 100 A). Instantaneous level for the circuit breaker 201 having a 20 A handle rating may be made to be between about 100 A and about 140 A in some embodiments.

The instantaneous level for the circuit breaker 201 having a 30 A handle rating may be less than about 240 A (including less than about 230 A, less than about 220 A, less than about 210 A, less than about 200 A, less than about 190 A, and even less than about 180 A). Instantaneous level for the circuit breaker 201 having a 30 A handle rating may be made to be between about 180 A and about 240 A in some embodiments.

In another aspect, by providing the assisting force F2, the instantaneous level for the circuit breaker 201 may be less than about 7× the handle rating of the circuit breaker 201, less than about 6× the handle rating of the circuit breaker 201, or even less than about 5× the handle rating of the circuit breaker 201.

As shown in FIG. 2C, in one or more embodiments, an end of the core 216 closest to the armature 242 may be spaced from the second portion 242B by a gap "G" of between about 0.5 mm and about 2.0 mm prior to being de-latched (i.e., the circuit breaker tripping mechanism 210 is shown in a latched condition as shown in FIG. 2C) to trip the circuit breaker 201. De-latching causes pivoting of the contact arm 211 and separates the first and second electrical contacts 206, 208.

In some embodiments, the gap "G" may be adjustable. Gap "G" may be adjusted by slightly bending the second portion 242B towards or away from the end of the core 216 in one embodiment. This may be used to adjust the assisting force F2 and thus the instantaneous level of the circuit breaker 201.

Additionally or optionally, the gap "G" may be adjusted by moving an axial position of the magnetic field generator 212 within the housing 202. The position may be adjusted, before or after circuit breaker assembly. This adjustment changes a relative axial position of the core 216 to the second portion 242B of the armature 242, as latched. The axial position may be moved by any suitable means. For example, the axial position may be adjusted by using washer-like insulating spacers (e.g., plastic spacers) to shift an axial location of the core 216, by using different housing inserts for insertion in the side chamber 224 with different axial locations of the retention features 230A, 230B, or by using cores 216 of different length.

In another embodiment, additionally or optionally, the assisting force F2 and thus the instantaneous level of the circuit breaker 201 may be adjusted by changing the number of coils of wire (# of windings) of the magnetic field generator 212. Other suitable means for adjusting the assisting force F2 may be used, either before or after assembly of the circuit breaker 201.

By making adjustments, as described above, the amount of assisting force F2 can be adjusted to meet various requirements for different instantaneous levels of the circuit breaker 201. In cases where the instantaneous level of the circuit breaker 201 is desired to fall only within a small predefined operating range, it is a manufacturing convenience provided by embodiments of the invention that the instantaneous level can be finely calibrated or recalibrated by adjusting the assisting force F2 according to one or more of the above means or other suitable means.

Now referring to FIGS. 2C and 3, an electrical device comprising a circuit breaker 201 and components thereof is illustrated. Circuit breaker 201 may be a molded-case circuit breaker having a handle rating of between about 15 A and 30 A, for example (including 15 A, 20 A and 30 A). A tripping mechanism 210 including a magnetic field generator 212 configured as part of a line conductor 223 as previously described is disposed in the circuit breaker 201. Otherwise, the circuit breaker 201 includes conventional breaker components.

For example, circuit breaker 201 may include conventional breaker components like line connector 222, load terminal 328, load conductor 329 (e.g., metal strap), bimetal 341 and magnet 239 of bimetal and magnet assembly 240, cradle 344 pivotal about cradle pivot 345, braided conductor 346, handle 247, and a spring 349 coupled between cradle 344 and contact arm 211 are entirely conventional and will not be explained in further detail.

FIG. 4 illustrates a circuit breaker 201 and its components and one possible assembly of components thereof. The circuit breaker 201 includes a first housing part 202A including circuit breaker components as shown in FIG. 3. Second housing part 202B may connect to first housing part 202A with intermediate housing part 202C positioned in between. Line conductor 223 may be installed as a separate component whereas the magnetic field generator 212 configured as part of the line conductor 223 may be received in side chamber 224, such as through cut-away 455 in the intermediate housing part 202C. Instantaneous level may be adjusted by changing out line conductor 223 with one with more or less coils of wire, or by shifting an axial position of the magnetic field generator 212 within the first housing part 202A.

Figure 5:
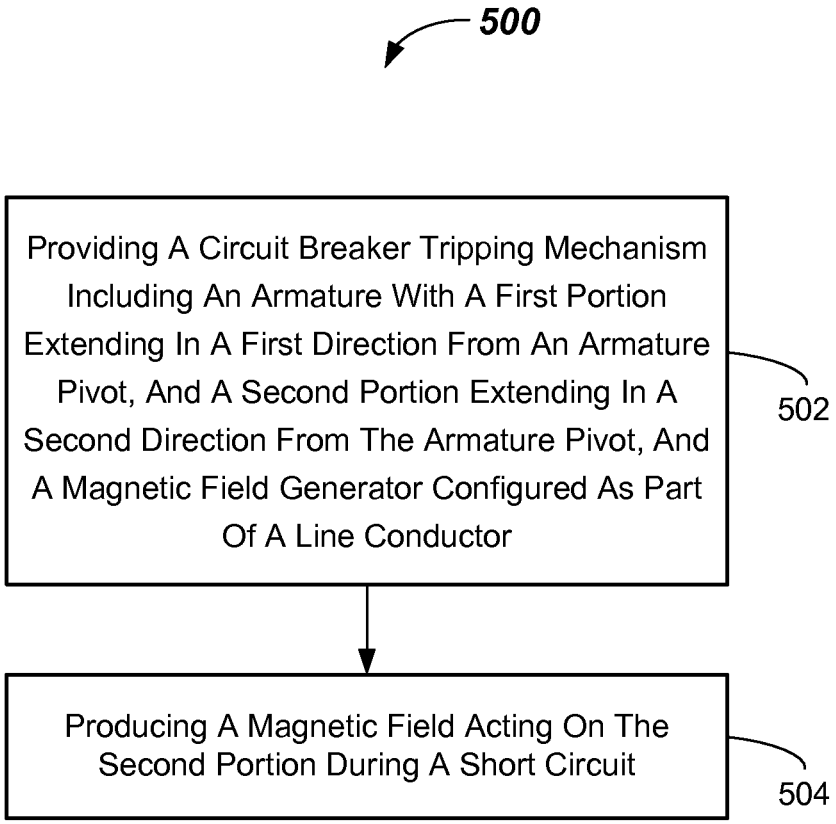
FIG. 5 illustrates a flowchart of a method of tripping a circuit breaker according to embodiments.

According to another aspect, a method of tripping a circuit breaker (e.g., circuit breaker 201) is provided. As shown in FIG. 5, the method 500 includes, in 502, providing a circuit breaker tripping mechanism (e.g., circuit breaker tripping mechanism 210) in the circuit breaker (e.g., circuit breaker 201) including an armature (e.g., armature 242) with a first portion (e.g., first portion 242A) extending in a first direction from an armature pivot (e.g., armature pivot 243), and a second portion (e.g., second portion 242B) extending in a second direction from the armature pivot, and a magnetic field generator (e.g., magnetic field generator 212) configured as part of a line conductor (e.g., line conductor 223).

The method 500 includes, in 504, producing magnetic field acting on the second portion during a short circuit. This produces the assisting force F2 as previously described. In operation, the magnetic field so generated is of sufficient strength so that the assisting force F2 attracts the second portion 242B during the short circuit. This effectively lowers the instantaneous level of the circuit breaker 201.

While the invention is susceptible to various modifications and alternative forms, specific embodiments and methods thereof have been shown by way of example in the drawings and are described in detail herein. It should be understood, however, that it is not intended to limit the invention to the particular apparatus, systems or methods disclosed, but, to the contrary, the intention is to cover all modifications, equivalents and alternatives falling within the scope of the invention.

What is claimed is:

1. A circuit breaker tripping mechanism, comprising:

a circuit breaker mechanism housing;

an armature including a first portion extending in a first direction from an armature pivot, and a second portion extending in a second direction from an armature pivot;

a magnetic field generator configured as part of a line conductor that is operable to produce a magnetic field acting on the second portion during a short circuit, wherein the magnetic field generator includes a core and a coil of wire of a line conductor wound about the core and electrically connected between a line power connection and a first electrical contact outside the circuit breaker mechanism housing; and a separating wall provided between a location of the first electrical contact, a second electrical contact and the magnetic field generator.

2. The circuit breaker tripping mechanism of claim 1, wherein the magnetic field generator is configured and operational to be energized by current flowing in the line conductor to produce a magnetic field that attracts the second portion.

3. The circuit breaker tripping mechanism of claim 1, wherein the magnetic field generator is positioned below an arc chamber of the circuit breaker.

4. The circuit breaker tripping mechanism of claim 1, wherein the magnetic field generator is configured and operational to provide a magnetic field strength in a core of the magnetic field generator of greater than 1 Tesla during the short circuit.

5. The circuit breaker tripping mechanism of claim 1, wherein the magnetic field generator is positioned in a housing of the circuit breaker by retention features.

6. A circuit breaker, comprising:

a housing;

a first electrical contact and a second electrical contact within the housing;

a line conductor electrically connected between the first electrical contact and a line connector;

a circuit breaker mechanism housing; and a circuit breaker tripping mechanism within the housing, including:

an armature including a first portion extending in a first direction from an armature pivot, and a second portion extending in a second direction from the armature pivot, a magnetic field generator configured as part of the line conductor that is operable to produce a magnetic field acting on the second portion during a short circuit, wherein the magnetic field generator includes a core and a coil of wire of a line conductor wound about the core and electrically connected between a line power connection and the first electrical contact outside the circuit breaker mechanism housing, and a separating wall provided between a location of the first electrical contact, the second electrical contact and the magnetic field generator.

7. The circuit breaker of claim 6, wherein an end of a core of the magnetic field generator is spaced by a gap (G) of between about 0.5 mm and about 2.0 mm from the second portion when the circuit breaker tripping mechanism is in a latched condition.

8. The circuit breaker of claim 6, wherein the magnetic field acting on the second portion during a short circuit produces an assisting force (F2), and the assisting force (F2) is adjustable by one of:

adjusting a gap (G);

adjusting an axial position of the magnetic field generator; and changing a number of windings of the magnetic field generator.

9. The circuit breaker of claim 6, comprising an instantaneous level that is less than about 7× a handle rating of the circuit breaker; or less than about 6× the handle rating of the circuit breaker, or even less than about 5× the handle rating of the circuit breaker.

* * * * *